United States Patent [19]

Boocock et al.

[11] 4,053,492

[45] Oct. 11, 1977

[54] EXTRACTION OF OIL FROM OATS

[75] Inventors: John Roger Brooke Boocock, Kingston; Richard Walton Oughton, Odessa, both of Canada

[73] Assignee: Du Pont of Canada Ltd., Montreal, Canada

[21] Appl. No.: 654,162

[22] Filed: Feb. 2, 1976

[30] Foreign Application Priority Data

Feb. 6, 1975 United Kingdom ..... 5056/75

[51] Int. Cl.[2] ..... C11B 1/10

[52] U.S. Cl. ..... 260/412.4; 260/123.5; 260/412.8; 423/417; 423/430

[58] Field of Search ..... 260/412.4, 412.8, 123.5; 426/430, 429, 417

[56] References Cited

U.S. PATENT DOCUMENTS

| | | | |
|---|---|---|---|
| 2,355,547 | 8/1944 | Musher | 426/162 |
| 3,338,932 | 8/1967 | Bates et al. | 260/412.8 |
| 3,630,754 | 12/1971 | Wayne | 426/430 |

FOREIGN PATENT DOCUMENTS

| | | | |
|---|---|---|---|
| 46-40746 | 12/1971 | Japan | 426/430 |

OTHER PUBLICATIONS

The Journal of the American Oil Chemists Soc., July 1953; issue vol. XXX, No. 7; pp. 288–291; Magne et al.

*Primary Examiner*—Winston A. Douglas
*Assistant Examiner*—P. E. Konopka

[57] ABSTRACT

A process for the extraction of oil from oats is disclosed. The process comprises extracting oil from comminuted oats with 2-propanol and separating the resultant 2-propanol solution from the de-oiled oats. Oat oil is recoverable from the 2-propanol solution. The 2-propanol may be in the form of an azeotropic mixture of 2-propanol and water. In a preferred embodiment the 2-propanol contains a minor amount e.g. 0.1– 1.0%, of hydrogen peroxide. The process is capable of producing a clear, lightly colored oil from oats. The oil is believed useful as a vegetable oil.

3 Claims, No Drawings

EXTRACTION OF OIL FROM OATS

The present invention relates to a process for extraction of oil from oats and in particular to the use of 2-propanol or mixtures of 2-propanol and hydrogen peroxide in a process for the extraction of oil from oats.

Oil from oats may be generally classed as a linoleic acid/oleic acid oil. For example, in Cereal Science, Editor S. A. Matz, published by AVI Publishing Co., Westport, Conn., U.S.A., 1969, it is stated on pages 90–91 that oat oil contains 42–45% polyunsaturated fats and that oats are an excellent source of linoleic acid, the latter being stated to be an essential fatty acid for the human diet. In addition, the composition of the fatty acids in oat oil is indicated to be approximately 60% oleic acid and approximately 30% linoleic acid. Oat oil is believed to contain a natural anti-oxidant which should tend to prevent rancidity of the oil. Oat oil is capable of being used as a vegetable oil in the food industry.

There are two principal methods of extracting oil from vegetable matter. For vegetable matter containing a relatively high proportion of oil, e.g., soybeans, olives and sunflowers, the oil may be obtained by pressing the vegetable matter. Oil not separated in the pressing process may be obtained by solvent extraction of the pressed vegetable matter, i.e., by extraction of the so-called "pulp". For vegetable matter containing a relatively low proportion of oil, e.g., oats, the oil is generally only obtained by solvent extraction techniques.

A wide variety of solvents have been used in the extraction of oil from oats. In the aforementioned reference in Cereal Science, extraction with diethyl ether, petroleum ether, carbon tetrachloride, chloroform, benzene, acetone and ethanol are mentioned. Oat oil has also been extracted with 1-butanol and hexane. A process for the extraction of oil from oats by sequentially extracting the oats with hexane, methanol/ethyl ether mixtures and acetone is described by E. L. Washburn in U.S. Pat. No. 2,636,888 which issued Apr. 28, 1953. An oxidation-free process for the extraction of oil from grain is described by W. Martin in U.S. Pat. No. 3,163,545 which issued Dec. 29, 1964.

The known solvents for the extraction of oil from oats suffer from a number of potential disadvantages. For example, both hexane and petroleum ether are solvents of relatively low flash point and the use of these solvents may require more stringent safety precautions. 1-Butanol has a relatively high boiling point and solution viscosity and if used in the presence of water forms at least two layers on cooling. The viscosity of 1-butanol may make the separation of solvent and the solid de-oiled oats more difficult than for other solvents. Acetone may denature the protein in the oats and for this reason may not be desirable for the extraction of the oil from the oats. The high specific gravity of trichloroethylene renders the separation of solvent and de-oiled oats more difficult. Moreover, as it is known that trichloroethylene may interact with soybeans to form toxic protein substances, similar interaction may occur in the extraction of oats. Furthermore, the oil extracted by these solvents may be coloured and require further treatment to give an oil of a pale colour which is commercially desirable. In addition, a solvent must have approval from the pertinent authorities before it can be used in processes associated with the food industry.

It has now been found that when 2-propanol is used as the solvent for the extraction of oil from oats the solvent solution may be readily separated from the de-oiled oats and that an essentially clear, lightly coloured oil is obtained from the solvent solution.

Accordingly, the present invention provides a process for the extraction of oil from oats comprising the steps of a. extracting oil from comminuted oats by treating said oats with 2-propanol, and
b. separating the resultant 2-propanol solution from the de-oiled oats so obtained.

In a preferred embodiment of the process of the present invention the oil is separated from the 2-propanol solution.

In a further embodiment an azeotropic mixture of 2-propanol is used.

In another embodiment the temperature of the 2-propanol during extraction of oil is in the range of from about 10° C to about 75° C, especially ambient temperatures.

The present invention also provides a process for the extraction of oil from oats comprising the steps of:

a. extracting oil from comminuted oats by treating said oats with 2-propanol, said 2-propanol containing a minor amount of hydrogen peroxide, and
b. separating the resultant 2-propanol solution from the de-oiled oats so obtained.

The process of the present invention is preferably carried out on dehulled oats. Techniques for dehulling oats are known in the art. The dehulled oats are comminuted in order to facilitate extraction of oil. Comminuted oats may be referred to hereinafter as comminuted groats. Extraction of oil, and of protein if protein is to be extracted in a subsequent process, is facilitated by small particle size of the comminuted groats. However, separation of solid material from liquids in the process, i.e., separation of the 2-propanol solution from the comminuted groats after de-oiling, is facilitated by large particle size. Thus, the particle size of the comminuted groats should be selected so as to facilitate both the extraction of oil from the comminuted groats and the subsequent separation of the de-oiled groats from the 2-propanol solution in the process. In the selection of the particle size consideration should be given to the requirements of any process to which the de-oiled groats may be subsequently subjected to. The optimum size will depend at least in part on the particular technique used in the extraction of the oil. A particle size of about 20 mesh (TYLER* Standard Screen Size) may be a suitable size.

* denotes trademark

The comminution of the dehulled oats may be accomplished by known techniques, for example, by grinding, pinmilling or by rolling. In order to obtain the desired particle size, it may be desirable to screen out the particles of desired size on, for example, a continuous basis, the comminuted groats particles that are oversized being recirculated to the comminution step, or by using air classification techniques.

After comminution of the dehulled oats, the resultant comminuted groats are extracted with a solvent so as to effect separation of the oil. In the process of the present invention the solvent is 2-propanol or mixtures of 2-propanol and water, especially azeotropic mixtures. As exemplified hereinafter, the use of such solvents results in an oil that is surprisingly clear and lightly coloured compared to the product obtained when other solvents, e.g., 1-butanol, hexane, 1-propanol and the like, are used.

In an especially preferred embodiment of the process of the present invention the solvent is comprised of a mixture of 2-propanol and a minor amount of hydrogen peroxide. Such mixtures may be used to obtain an oil that is substantially lighter in colour than the oil that is obtained when 2-propanol is used as the solvent for the extraction of the oil from the oats. As used herein the term "minor amount" defines that amount of hydrogen peroxide which if increased does not result in a further significant reduction in the colour of the oil that is obtained. Preferably less than 1% by weight of hydrogen peroxide, especially 0.1–1.0% by weight of hydrogen peroxide, is used.

Techniques applicable to the extraction of oil from oats are known. For example, the solvent may be passed through a bed of comminuted groats or the comminuted groats and solvent may be admixed in the form of a slurry. The extraction is continued until the oil content of the comminuted groats is reduced to the desired level, for example, 0.2% by weight of the comminuted groats.

After extraction of the oil from the comminuted groats the resultant solvent/oil solution is separated from the de-oiled groats. If in the process the solvent is passed through a bed of comminuted groats the solvent-/oil solution may be readily separable from the de-oiled groats. For example, the solution may be diverted to another vessel or a portion of the solvent/oil solution may be diverted to another vessel on a continuous or periodic basis. Alternatively, if, for example, the comminuted groats and solvent are mixed so as to form a slurry alternate separation techniques may be required. A preferred technique involves the use of a centrifuge.

After separation of the solvent/oil solution from the de-oiled groats the solvent may be separated from the oil. Distillation is the preferred technique for such separation. As 2-propanol and its azeotrope are relatively low boiling, separation is readily obtainable. The oil so obtained may be subjected to further treatment, if necessary, or sold as such.

The extraction step of the process is preferably operated at as low a temperature as is practical especially if the de-oiled oats are to be subsequently treated for the separation of other constituents and/or the solvent is a mixture of 2-propanol and hydrogen peroxide. Low temperatures are believed to reduce any tendency of the solvent to denature the protein. Preferred temperatures are from 10° C to 75° C, especially ambient temperatures, with temperatures in the range of from 10° C to 40° C being particularly preferred when the solvent is a mixture of 2-propanol and hydrogen peroxide. For the separation of the solvent from the oil temperatures up to the boiling point of the solvent are operable and practical. Higher temperatures might be undesirable on economic grounds.

The solvent is conveniently separated from the oil by distillation under atmospheric pressure.

Oats may be extracted with solvent primarily for recovery of the oil in the oats. Alternatively, the extraction of oil from oats may be one step in a process for the separation of other components in the oats. For example, the extraction of oil may be one step in a process for the separation of acid-soluble protein from oats as is disclosed in the copending application of A. Bell, J. R. B. Boocock and R. W. Oughton filed on the same day as the present application. The oil may be used as, for example, a vegetable oil in food end uses.

The process of the present invention is operable as a continuous or batch process or any combination thereof.

The process of the present invention is illustrated by the following examples:

EXAMPLE I

A dehulled oat, known as Hinoat and obtained from Agriculture Canada, Ottawa, Ontario, was ground to −20 mesh (TYLER Standard Screen Size). 80 g of the resultant ground groats were placed in a cellulose thimble and extracted with 600 ml of solvent in a Soxhlet extractor for a period of 6 hours. The extraction was repeated using two additional 80 g samples of the ground groats. The solvent solutions obtained from the three extractions were combined and approximately 90% of the solvent was distilled off. The remaining solvent solution was centrifuged to remove solid material which is believed to be primarily starch. The remaining solvent was removed from the resulting supernatant liquid using a steam bath. Any residual solvent was removed overnight in a vacuum oven at ambient temperature.

The results obtained are given in TABLE I.

TABLE I

| Solvent | Oil Extracted (% by weight) | Oil Properties Colour | Oil Properties Clarity | Comments |
|---|---|---|---|---|
| methanol | 4.52 | Dark brown | Opaque | Oil was solid |
| ethanol | 4.45 | Orange | Opaque | Solids in oil |
| 1-propanol | 5.22 | Black | Opaque | Solids in oil |
| 2-propanol | 3.20 | Light orange | Clear | Some solids in oil |
| t-butanol | 3.58 | Brown | | Solids in oil |
| hexane | 5.73 | Tan brown | | Solids in oil, oil viscous |

EXAMPLE II

The effects of solvent and extraction temperature were demonstrated using the following procedure.

Approximately 4 kg of the dehulled oat of Example I was ground to −20 mesh (TYLER Standard Screen Size). Approximately 15 g of the ground groats were admixed, in the form of a slurry, with 150 ml of solvent at the selected temperature (ambient temperature of 70° C). The slurry was stirred continuously. After 1 hour the solvent solution obtained was separated from the ground groats using a centrifuge. The ground groats were then admixed, in the form of a slurry, with a further 150 ml of solvent for 1 hour. The resulting solvent solution was separated from the fround groats using a centrifuge and combined with the first solvent solution. The solvent was removed from the solution using a steam bath and a vacuum oven, as described in Example I.

All solvent extractions were carried out in duplicate and the averaged results are given in TABLE II.

TABLE II

A. Extraction at Ambient Temperature using Anhydrous Solvent

| Solvent | Oil Extracted (% by weight) | Oil Properties Colour | Oil Properties Clarity | Comments |
|---|---|---|---|---|

TABLE II-continued

| | | | | |
|---|---|---|---|---|
| hexane | 5.0 | Dark brown | Opaque | |
| methanol | 5.2 | Orange | Opaque | Solids in oil |
| ethanol | 5.2 | Light orange | Clear | Solids in oil |
| 1-propanol | 5.4 | Dark brown | Opaque | Solids in oil |
| 2-propanol | 4.9 | Light orange | Clear | Some solids in oil |
| 1-butanol | 5.7 | Dark brown | Opaque | Solids in oil |
| 2-butanol | 4.8 | Orange | Opaque | Solids in oil |
| t-butanol | 5.3 | Dark brown | Opaque | Solids in oil |
| t-amyl alcohol | 5.6 | Dark brown | Opaque | Solids in oil |
| acetone | 4.2 | Light orange | Opaque | Solids in oil |

B. Extraction at Ambient Temperature using Azeotropic Solvent/Water Mixture

| Solvent | Oil Extracted (% by weight) | Oil Properties Colour | Oil Properties Clarity | Comments |
|---|---|---|---|---|
| hexane | 4.1 | Dark brown | Opaque | |
| methanol | 4.9 | Light orange | Opaque | Oil was solid |
| ethanol | 5.5 | Light orange | Clear | Solids in oil |
| 1-propanol | 4.7 | Dark brown | Opaque | |
| 2-propanol | 5.4 | Light orange | Opaque | Solids in oil |
| 1-butanol | 5.5 | Dark brown | Opaque | Solids in oil |
| 2-butanol | 5.9 | Light orange | Opaque | |
| t-butanol | 5.0 | Dark orange | Opaque | Solids in oil |
| t-amyl alcohol | 6.5 | Orange | Opaque | Solids in oil |
| acetone | 4.5 | Dark orange | Clear | Solids in oil |

C. Extraction at 70° C using Anhydrous Solvent

| Solvent | Oil Extracted (% by weight) | Oil Properties Colour | Oil Properties Clarity | Comments |
|---|---|---|---|---|
| hexane | 4.9 | Brown | Opaque | Solids in oil |
| methanol | 8.3 | Dark brown | Opaque | Solids in oil |
| ethanol | 6.5 | Orange | Opaque | Solids in oil |
| 1-propanol | 6.7 | Dark brown | Opaque | Oil was solid |
| 2-propanol | 6.6 | Light brown | Opaque | Solids in oil |
| 1-butanol | 7.2 | Brown | Opaque | Solids in oil |
| 2-butanol | 7.6 | Yellow | Opaque | Solids in oil |
| t-butanol | 6.7 | Brown | Opaque | Oil was solid |
| t-amyl alcohol | 7.7 | Light yellow | Opaque | Oil was solid |
| acetone | 5.3 | Dark brown | Opaque | Solids in oil |

D. Extraction at 70° C using Azeotropic Solvent/Water Mixture

| Solvent | Oil Extracted (% by weight) | Oil Properties Colour | Oil Properties Clarity | Comments |
|---|---|---|---|---|
| hexane | 5.5 | Brown | Opaque | Solids in oil |
| methanol | 9.3 | Brown | Opaque | Solids in oil |
| ethanol | 6.7 | Dark orange | Opaque | Solids in oil |
| 1-propanol | 11.5 | Dark brown | Opaque | Oil was solid |
| 2-propanol | 7.3 | Dark brown | Clear | Solids in oil |
| 1-butanol | 8.0 | Dark brown | Opaque | Solids in oil |
| 2-butanol | 9.4 | Orange | Opaque | Solids in oil |
| t-butanol | 7.2 | Brown | Opaque | Solids in oil |
| t-amyl alcohol | 7.9 | Orange | Clear | Solids in oil |
| acetone | 6.4 | Dark brown | Opaque | Solids in oil |

In general 2-propanol gave the oil of the lightest colour and best clarity.

EXAMPLE III

A dehulled oat, known as Indian Head CI 4492 and obtained from Agriculture Canada, Ottawa, Ontario, was ground to −20 mesh (TYLER Standard Screen Size). Approximately 15 g samples were extracted, in duplicate, with either hexane or 2-propanol at ambient temperature using the procedure of Example II.

The results obtained are given in TABLE III.

TABLE III

| Solvent | Hexane | 2-Propanol |
|---|---|---|
| Oil Extracted (% by weight) | 9.47 | 9.18 |
| Colour of oil | Dark brown | Light yellow |
| Clarity | Opaque* | Clear |
| Free Acid (%) | 11.4 | 5.6 |
| Oleic Acid (%) | 5.7 | 2.8 |
| Iodine Number | 92.1 | 90.9 |
| Total Acid Residue (%) | | |
| $C_{16}$ acids | 21 | 21 |
| $C_{18}$ saturated acids | < 1 | 1 |
| $C_{18}$ mono-unsaturated acids | 51 | 52 |
| $C_{18}$ di-unsaturated acids | 19 | 19 |
| $C_{18}$ tri-unsaturated acids | <1 | 1 |
| $C_{20}$ mono-unsaturated acids | 6 | 4 |
| $C_{20}/C_{22}$ acids** | 3 | 2 |

*muddy in appearance
**$C_{20}$ di- and tri-unsaturated acids and $C_{22}$ mono-unsaturated acids

EXAMPLE IV

A 20 g sample of dehulled Hinoat oat that had been pin-milled was weighed into a cellulose extraction thimble of a Soxhlet apparatus. The sample was then treated with 150 ml of reagent grade 2-propanol for a period of two hours. The resultant 2-propanol solution was then centrifuged so as to remove any solid matter. After evaporation of the 2-propanol from the solution 0.84 g of oat oil was obtained.

The above procedure was repeated except that 2 ml of a 35% by weight solution of hydrogen peroxide was added to the 2-propanol. 1.28 g of oat oil was obtained. This oat oil was very pale in colour, being substantially lighter in colour than the oil obtained in the absence of the addition of hydrogen peroxide to the 2-propanol.

The embodiments of the invention in which an exclusive property or privilege is claimed are defined as follows:

1. A process for the extraction of oil from comminuted dehulled oats comprising the steps of:

a. extracting oil from said comminuted dehulled oats by treating said oats with 2-propanol, said 2-propanol containing a minor amount of from about 0.1 weight percent to about 1.0 weight percent of hydrogen peroxide, at a temperature of from about 10° C to about 75° C whereby oil in the oats in extracted by said 2-propanol, b. separating the resultant solution comprising 2-propanol and extracted oil from the thus deoiled oats, and c. separating the oil from the 2-propanol.

2. The process of claim 1 in which the 2-propanol contains less than 1% by weight of hydrogen peroxide.

3. The process of claim 1 in which the temperature of the 2-propanol during said extraction is in the range of from 10° C to 40° C.

* * * * *